US005964462A

United States Patent [19]

Saltsov

[11] Patent Number: 5,964,462

[45] Date of Patent: Oct. 12, 1999

[54] LINKAGE DRIVE ARRANGEMENT FOR CURRENCY VALIDATORS

[75] Inventor: Leon Saltsov, Thornhill, Canada

[73] Assignee: Cashcode Company Inc., Concord, Canada

[21] Appl. No.: 08/982,514

[22] Filed: Dec. 2, 1997

[51] Int. Cl.[6] ..... B65H 5/06

[52] U.S. Cl. ..... 271/274; 198/624; 271/264

[58] Field of Search ..... 198/624; 271/272, 271/273, 274, 264; 902/7, 8

[56] References Cited

U.S. PATENT DOCUMENTS 4,513,439 4/1985 Gorgone et al. ..... 194/206
4,909,499 3/1990 O'Brien et al. ..... 271/273
5,762,332 6/1998 Haroutel et al. ..... 271/274
5,829,743 11/1998 Delland et al. ..... 271/272

*Primary Examiner*—H. Grant Skaggs

[57] ABSTRACT

A drive linkage arrangement for a bill validator maintains driver rollers in synchronization as a bill is driven along a predetermined path for scanning thereof. The drive linkage is a parallelogram linkage with three nodes of the linkage driving drive rollers. The fourth node of the linkage is connected to the output of a gear box driven by a drive motor. The linkage is a cost effective reliable approach for distributing power of a single motor to the spaced drive rollers.

6 Claims, 1 Drawing Sheet

LINKAGE DRIVE ARRANGEMENT FOR CURRENCY VALIDATORS

FIELD OF THE INVENTION

The present invention relates to currency validators, and in particular, relates to a drive arrangement used in currency validators.

BACKGROUND OF THE INVENTION

There are many examples of currency validators for use in association with vending machines of different types, and these currency validators have an entry slot into which a bill is inserted, and a drive arrangement engages the bill and drives the bill along a predetermined path past a number of scanning operations, to determine whether the bill is authentic. If the bill is determined to be authentic, it is accepted, and an appropriate credit or dispensing product results. If the bill is not accepted, the drive reverses direction, causing the bill to be ejected out of the entry slot.

It is known in currency validators, to have a drive motor connected, by a series of meshing gears, to a series of drive rollers, positioned along this predetermined path. In this way, one motor drives the various drive rollers, and then the drive rollers are maintained in synchronization by the gear drive train. Although it is desired to keep the path fairly short and relatively compact, the drive rollers can be spaced at least several inches therebetween, and the gear drive train between rollers can be somewhat large. It has also been known to connect these drive rollers by means of a drive belt arrangement between the drive motor, and the various drive rollers, or using a longer belt for connecting all the drive rollers and drive motor. However, the drive belt arrangement is less accurate and the drive wheels are not necessarily kept in synchronization. The drive belt arrangement certainly simplifies the drive arrangement, relative to a gear drive arrangement, but is not as robust, nor as reliable.

It is desirable to drive the bill at various points along the path, to cause a bill to move from the entry slot to a discharge location. It is also desirable to maintain the cost for manufacturing of the validator as low as possible. The drive arrangement is a significant component in the overall cost of the validator.

SUMMARY OF THE INVENTION

A bill drive arrangement for a currency validator comprises an entry slot for feeding a bill longitudinally into the currency validator, a drive path along which a bill is driven for evaluation, a drive motor arrangement having a drive shaft, and a crank arm connected to, and driven by the drive shaft, with this crank arm driving a parallelogram linkage connecting the crank arm with three spaced drive rollers. Each drive roller is rotated in time sequence with the rotation of the crank arm, as driven by the drive motor. Each drive roller is located to one side of the drive path, and the drive roller engages and drives a bill along the path as it is processed by the validator. This drive arrangement advantageously uses a single drive motor and a linkage arrangement, for maintaining the drive rollers in timed sequence. The linkage is simple to manufacture, robust in design and maintains positive synchronization of the drive rollers.

According to an aspect of the invention, the parallelogram linkage has four link arms, and each drive roller is connected to the linkage at a pivot connection between two adjacent link arms of the parallelogram linkage.

According to yet a further aspect of the invention, the drive rollers are of equal diameter, and connected to the parallelogram linkage an equal distance from a centre access of each drive roller.

According to yet a further aspect of the invention, each drive roller has an associated spring bias idler wheel, located to the side of a path, opposite to the drive roller. Each associate idler wheel is in contact with the associated drive roller, and moveable away therefrom, against the spring bias, to accommodate driving a bill between the idler roller and the drive roller, forcing the bill along the path.

According to yet a further aspect of the invention, the drive path has a first segment and a second segment connected by a curved transition. The first and second segment are straight, and located perpendicular to each other. One of the drive rollers is located at the curved transition, and one of the drive rollers is located on the first segment, and the remaining drive roller is located on the second segment.

According to yet a further aspect of the invention, the drive motor arrangement includes a drive motor driving a gear box, having the drive shaft as an output shaft of the gear box.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
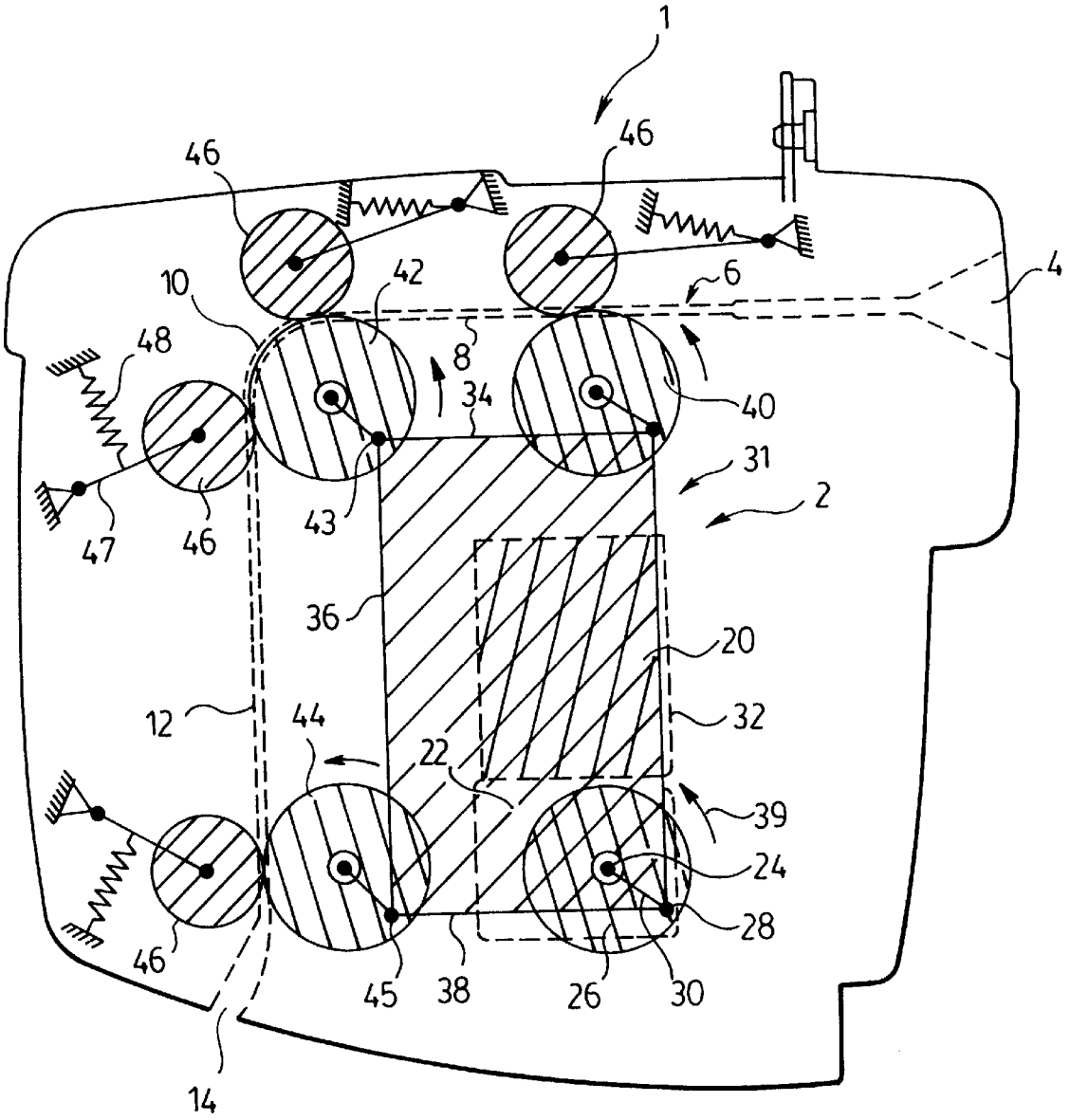
FIG. 1 is a side sectional elevational view showing the drive arrangement in a currency validator.

The currency validator 1 shown in the drawing, has a bill drive arrangement 2 for driving a bill inserted in the entry slot 4 along the path 6 to the discharge slot 14. The path 6 includes a first segment 8, a curved transition 10, and a second straight segment 12. The first and second segment are generally perpendicular to one another, and joined by the curved transition.

The bill drive arrangement 2 includes a drive motor 20 having an associated gear box 22 with an output shaft 24. This output shaft supports the drive wheel 26, having a pivot connection 28 connected to a parallelogram linkage 31. This parallelogram linkage forms a drive linkage connecting the drive rollers 40, 42 and 44, and maintaining synchronization therebetween.

The parallelogram linkage 31 includes link 32, connected to link 34, and in turn connects to link 36, which is connected to link 38, which closes the linkage by being connected to link 32. Links 32 and 38 are connected to the drive wheel 26 at the pivot connection 28. Links 32 and link 34 are connected to the drive roller 40 at the pivot connection 41. Drive roller 42 is connected to linkage 34, and linkage 38 at pivot connection 43. Drive roller 44 is connected to linkage 36 and linkage 38 at the pivot connection 45. It can be seen that the drive rollers 40, 42, and 44 are of equal diameter, and each has an equal length crank arm defined by the position of the pivot connection on the roller, to cause the roller to rotate with rotation in the direction of arrow 39, when the motor 20 is driven in one direction. Motor 20 is reversible, and thus, the rollers and drive wheel can rotate in either direction, as determined by the motor. The drive rollers 40, 42, and 44 are merely driven in accordance with the position of the drive wheel 26, which is rotated by the output shaft 24 of the gear box 22. This gear box is driven by the drive motor 20.

With this arrangement, a simple parallelogram linkage is used to maintain synchronization of the various drive rollers. The drive rollers are located to one side of the path 6, and each of these drive rollers has at least one spring biased idler roller associated therewith. The idler rollers are commonly identified as 46, and each of them include a support arm 47, and a spring 48, for providing a spring bias, urging the idler roller towards the drive roller and accommodating the thickness of a bill as it passes between the drive roller and idler roller.

As the bill passes along the length of the pass 6, various scanning operations, such as magnetic and/or optical scans, are carried out to determine whether the bill is authentic. By the time the bill is approaching the discharge slot 14, the validator has determined whether the bill is valid. If it is valid, it is allowed to pass through the discharge slot 14, into a security box or into a stacker arrangement, as is known in this art.

If the bill is not accepted, the motor 20 is reversed, causing a reversing of the drive linkage and drive rollers such that the bill is ejected at the entry slot 4.

With the present drive arrangement, a parallelogram linkage is used to connect a drive wheel, having a crank arm, to a parallelogram linkage, for driving the drive rollers. The drive rollers are preferrably the same size, and have pivot connections with the parallelogram linkage at the same distance from the axis of rotation of each roller. In this way, the parallelogram linkage causes the same rotation to occur to each of the drive rollers, and it can also be appreciated that this parallelogram linkage can be used to drive additional drive rollers, if necessary.

The parallelogram linkage provides an effective mechanism for providing distributed power at the drive rollers. Preferrably, the power is a direct connection of the linkage to the drive rollers but other arrangements of connecting the drive roller to the linkage adjacent the rollers, can effectively utilize the benefit of the linkage.

In a preferred embodiment of this invention, the gear box has a drive wheel associated therewith, which is the same size as the drive rollers, and has a pivot connection with the linkage spaced the same distance from the axis of rotation 24 of the drive wheel, as is used with the drive rollers. A small compact gearbox 22 is associated with the drive motor 20, for reducing the speed of the drive motor. This drive arrangement is less expensive than a similar drive arrangement, where various gears are in mesh, and it is simpler and more reliable than a belt drive arrangement.

It is important to have a reliable drive arrangement, as it is expensive to service validators, and customers demand validators which are not prone to breakdown. This drive linkage has proven effective, and is particularly effective with the path having a first straight segment and a second straight segment, joined by a curved transition. The drive rollers are located on the first segment and second segment, and the curved transition with the drive motor provided at a central location and spaced very significantly from the drive path. This provides effective use of the space to one side of the drive rollers, and allows sensors to be placed centrally along the path, and a substantial distance away from the drive motor.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A bill drive arrangement for a currency validator comprising an entry slot for feeding a bill longitudinally into a currency validator, a drive path along which a bill is driven for evaluation, a drive motor arrangement having a drive shaft and a crank arm connected to and driven by said drive shaft, said crank arm driving a parallelogram linkage connecting said crank arm with three spaced drive rollers, each drive roller being rotated in timed sequence with rotation of said crank as driven by said drive motor, and wherein each drive motor is located to one side of said drive path and engages and drives a bill along said path as it is processed by said validator.

2. A bill drive arrangement as claimed in claim 1 wherein said parallelogram linkage has four link arms and each drive roller is connected to said linkage at a pivot connection between two adjacent link arms of said parallelogram linkage.

3. A bill drive arrangement as claimed in claim 2 wherein said drive rollers are of equal diameter and connected to said parallelogram linkage an equal distance from a center axis of each drive roller.

4. A bill drive arrangement as claimed in claim 2 wherein each drive roller has an associated spring biased idler wheel located to a side of said path opposite to the drive roller, each associated idler wheel being in contact with the associated drive roller and movable away therefrom against said spring bias to accommodate driving a bill therebetween and along said path.

5. A bill drive arrangement as claimed in claim 4 wherein said drive path has a first segment and a second segment connected by a curved transition, said first segment and said second segment being straight and located perpendicular to each other, and wherein one of said drive rollers is located at said curved transition, one of said drive rollers is on said first segment and one of said drive rollers is located on said second segment.

6. A drive arrangement as claimed in claim 1 wherein said drive motor arrangement includes a drive motor driving a gear box having said drive shaft as an output shaft of said gear box.

* * * * *